United States Patent [19]

Mortensen

[11] Patent Number: 5,062,465

[45] Date of Patent: Nov. 5, 1991

[54] PROCEDURE FOR CONVEYING MOLDS, AND A PLANT FOR THAT PURPOSE

[75] Inventor: Anders Mortensen, Brønshøj, Denmark

[73] Assignee: Dansk Industri Syndikat A/S, Herlev, Denmark

[21] Appl. No.: 596,715

[22] Filed: Oct. 9, 1990

[30] Foreign Application Priority Data

Oct. 16, 1989 [DK] Denmark ..... 5132/89

[51] Int. Cl.[5] ..... B22C 11/08; B22D 47/02

[52] U.S. Cl. ..... 164/4.1; 164/130; 164/154; 164/323

[58] Field of Search ..... 164/130, 323, 4.1, 154, 164/456

[56] References Cited

U.S. PATENT DOCUMENTS

| | | | |
|---|---|---|---|
| 3,612,159 | 10/1971 | Galinsky | 164/323 |
| 3,627,028 | 12/1971 | Carignan | 164/130 X |
| 3,955,613 | 5/1976 | Lund | 164/130 |
| 4,248,290 | 2/1981 | Hermes | 164/323 X |

FOREIGN PATENT DOCUMENTS

| | | | |
|---|---|---|---|
| 3011265 | 3/1981 | Fed. Rep. of Germany . | |
| 3706210 | 9/1988 | Fed. Rep. of Germany | 164/323 |
| 60-255261 | 12/1985 | Japan | 164/130 |
| 61-266171 | 11/1986 | Japan | 164/130 |
| 846103 | 7/1981 | U.S.S.R. | 164/323 |

*Primary Examiner*—J. Reed Batten, Jr.

*Attorney, Agent, or Firm*—Larson & Taylor

[57] ABSTRACT

Molds are conveyed from the delivery end (2) of a molding machine (1) to a cooling conveyor (3) or an extractor station. By this procedure the molds (4) are principally conveyed in a direction away from the molding machine in close contact with each other on the first conveyor (5), where the pouring takes place. Then the molds (4) are conveyed back in the direction of the molding machine (1) on a second conveyor (6) running parallel to the first conveyor, on which second conveyor the initial cooling and solidification takes place. The molds with the partially cooled castings are then pushed on to a cooling conveyor (3) or an extractor station by the action of a reciprocating ejector element (7). The molds (4) are checked when being delivered from the molding machine (1), and molds (4') with irregularities or flaws are pushed away transversely (8) from the first conveyor (4) in the direction of the second conveyor (6) immediately after having left the molding machine (1), after which the molds (4) are conveyed on away from the cooling conveyor (3) or the extraction station by the action of an ejector element (7). The ejector element (7) has an ejector blade (12), which can be swung up above the level of the molds (4), whereby a pallet cross-conveyor (8), which is adapted to move empty pallets between the two conveyors can at the same time be used during its return stroke to take molds (4') direct from the delivery end of the molding machine to the ejector position at the exit end of the second conveyor (6).

5 Claims, 3 Drawing Sheets

PROCEDURE FOR CONVEYING MOLDS, AND A PLANT FOR THAT PURPOSE

Figure 1:
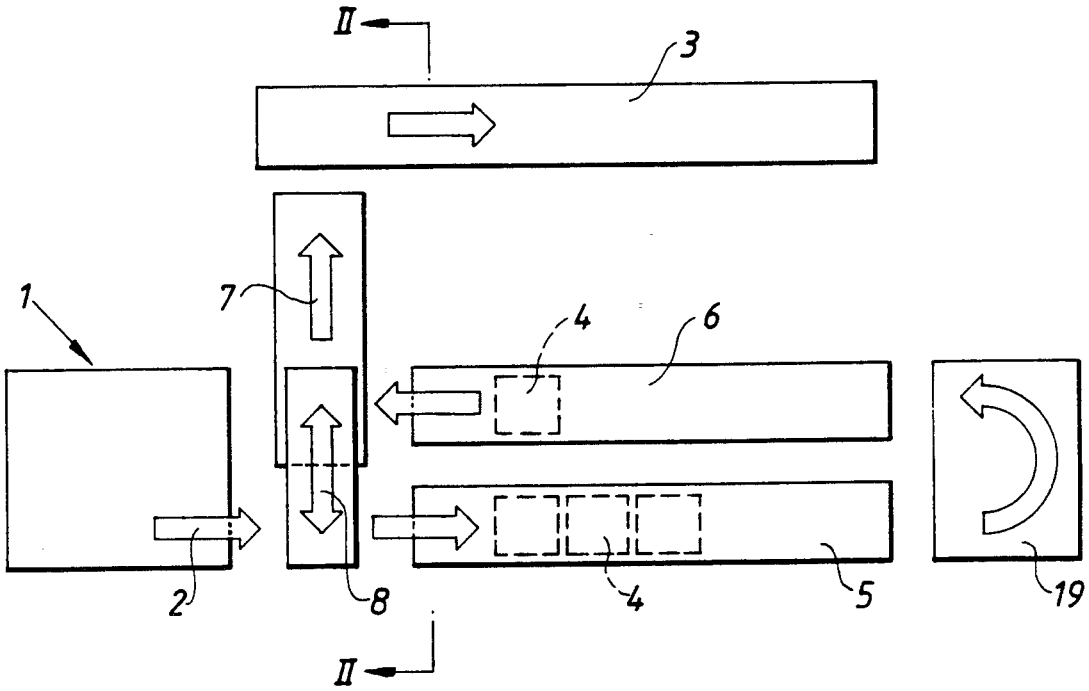

The present invention relates to a procedure for conveying molds from the delivery end of a molding machine to a cooling conveyor or an extractor station. By this procedure the molds are conveyed principally in a direction away from the molding machine in close contact with each other on the first conveyor, where the pouring takes place. Then the molds are returned in the direction of the molding machine on the second conveyor running parallel to the first one, where the initial cooling and solidifying take place. The molds with the partly cooled castings are then ejected on to a cooling conveyor or an extractor station by the action of a reciprocating ejector element.

In a known plant (DE-PS 30 11 265) a procedure of this kind is used. In the known plant all the molds delivered from the molding machine are conveyed onwards along the two conveyors, passing through the whole distance from the delivery end of the molding machine to the cooling conveyor. In the cases where the molds are defective or if for any other reason it is not desirable that they should be poured, steps must be taken to prevent pouring into such molds. In practice this is often done by a simple external marking of the molds as a signal to the operator controlling the pouring machine. In addition to complicating the pouring, such molds also cause an unwanted reduction of the total capacity of the plant, because the "wrong" molds take up space for the "normal", non-defective molds to be poured. The "wrong" molds may be molds in which the sand shot has failed, or it is simply the first half mold made at the beginning of each pattern change.

The object of the invention is to provide a procedure and a plant where the "wrong" molds are removed from the conveyor before they reach the pouring station.

According to the present invention this is achieved by the procedure referred to in the preamble and characterized in that the molds are checked when being delivered from the molding machine, and that the molds with irregularities or flaws are ejected transversely from the first conveyor in the direction of the second conveyor immediately after having left the molding machine, whereupon the molds with flaws are conveyed on to the cooling conveyor or the extractor station by the action of the ejector element.

In this manner an effective removal of the "wrong" molds is achieved just by providing a unit providing transverse conveying over the usually relatively short distance between the two conveyors. When the "wrong" molds have been transferred to the opposite conveyor, they enter the row of poured molds and are conveyed on through the plant by means of the same equipment as the other molds.

At a procedure of the type where the molds from the molding machine are delivered to a transport pallet on which the molds are conveyed principally along the first and the second conveyors, in that a cross-conveyor has been provided for taking empty pallets from the exit end of the second conveyor to the entry end of the first conveyor, it is advantageous according to the present invention to use the cross-conveyor for taking pallet and flawed molds from the entry end of the first conveyor to the exit end of the second conveyor during the return stroke of the cross-conveyor while the ejector element is being removed from the moving path of the molds.

By this procedure a further simplification is achieved of the equipment required for using the invention, because the already existing pallet conveyor constitutes the unit that executes the transverse transfer between the two conveyors.

The present invention also relates to a plant for using the above procedure. The plant comprises a molding machine, a first conveyor on which the molds delivered from the molding machine are conveyed closely held together end-to-end, and along which the pouring is carried out, a turning station on which the molds are turned 180° individually, and a second conveyor on which the molds and the poured castings are cooled, while the closely held molds are being carried back to the molding machine, an ejector element being provided at the exit end of the second conveyor, which element is adapted to take the molds to a cooling conveyor or an extractor station. The plant is characterized by a cross-conveyor unit being provided at the delivery end of the molding machine, which unit in combination with an ejector element is adapted to convey molds direct from the entry end of the first conveyor to the cooling conveyor or the extractor station.

By placing the cross-conveyor unit immediately after the delivery end of the molding machine, it is made possible to convey "wrong" molds transversely from one conveyor to the other before the molds are pressed firmly together, as it is the case with "normal" molds, which are conveyed on the first conveyor and in below the pouring station. It is therefore possible to design an extremely simple unit, as it is only a matter of shifting molds translationally between the two conveyors.

In a plant where the molds with horizontal dividing surfaces are conveyed on separate pallets rolling on pairs of wheels, with pairs of wheels provided with friction coating and respectively driving and braking the pallets, and placed at the entry and exit ends of the first and the second conveyors, and where between the delivery end of the molding machine and the first conveyor is placed a pallet cross-conveyor designed to take empty pallets from the exit end of the second conveyor to the entry end of the first conveyor, whereby the ejector element is provided with an ejector blade projecting down to the top side of the pallet in the area between the entry end of the first conveyor and the exit end of the second conveyor, it is expedient according to the present invention to let the ejector blade of the ejector element be pivotally suspended and adapted to swing to a level corresponding to at least the height of the molds above the top surface of the pallets.

In this manner the arrangement makes it possible to use the pallet cross-conveyor of the known plant to convey the "wrong" molds transversely to the conveyors, and it is only necessary to provide means for raising and lowering the ejector blade of the known plant.

In a plant according to the present invention means may be provided which are adapted for detecting molds with irregularities or flaws, and to emit an activating signal to the pallet cross-conveyor and the ejector element for swinging the ejector blade upwards.

In this manner it is made possible to remove automatically any "wrong" molds without any manual intervention on the part of the operator.

The invention will be explained in the following with reference to the drawing, in which FIG. 1 shows schematically in the form of a diagram the pattern of movement of the molds in a plant according to the invention, FIG. 2 a cross section through the plant at the arrows II—II on FIG. 1, and FIG. 3 an illustration corresponding to FIG. 2, but with the movable conveyors in another work position.

The diagram on FIG. 1 shows a molding machine for making flaskless mold parts, the so-called molds, designated by the reference FIG. 1. The delivery end of the molding machine is symbolized by the arrow 2. From the delivery end 2 the molds are delivered to a pallet cross-conveyor, which is symbolized by the double arrow 8. The molds 4 are placed with horizontal dividing line on an empty pallet. The pallet with the molds 4 are then conveyed forward along the pouring line 5, an in itself known weight iron being placed above the molds, for example of the type described in U.S. patent application Ser. No. 07/475,973. The weight iron, the top side of the pallet and the adjacent molds, abutting end-to-end because the pallets are a little shorter than the molds, together ensure that the molds are held together during and after the pouring, which takes place along the first conveyor 5. At the end of the first conveyor 5 there is a turning station 19, which is adapted in a swinging movement to take the pallets individually from the exit end of the first conveyor 5 to the entry end of the second conveyor 6. On the second conveyor 6 the molds are returned in the direction of the molding machine 1, while the castings are being cooled and obtain such a stability that the weight irons can be removed at the exit end of the conveyor. The molds are taken from the conveyor 6 on to the cross-conveyor 8, where the molds are ejected from the pallet and through an ejector channel on to a cooling conveyor 3 by the action of an ejector element, which is suggested at the arrow 7. The molds stand loosely among each other on the cooling conveyor 3 until the extraction can take place. When the molds have been removed from the pallet by the cross-conveyor 8, the empty pallet is taken by the cross-conveyor to the position in front of the delivery end 2 of the molding machine 1, whereupon a new cycle may begin.

In the cases where the molds are defective or for other reasons unsuitable for pouring, a possibility is provided by the present invention to take the "wrong" molds 4' direct from the entry end of the pouring line to the exit end of the cooling stretch 6. The "wrong" molds 4' are passed on through the ejector channel to the cooling conveyor or possibly direct to the extractor station.

Figure 2:
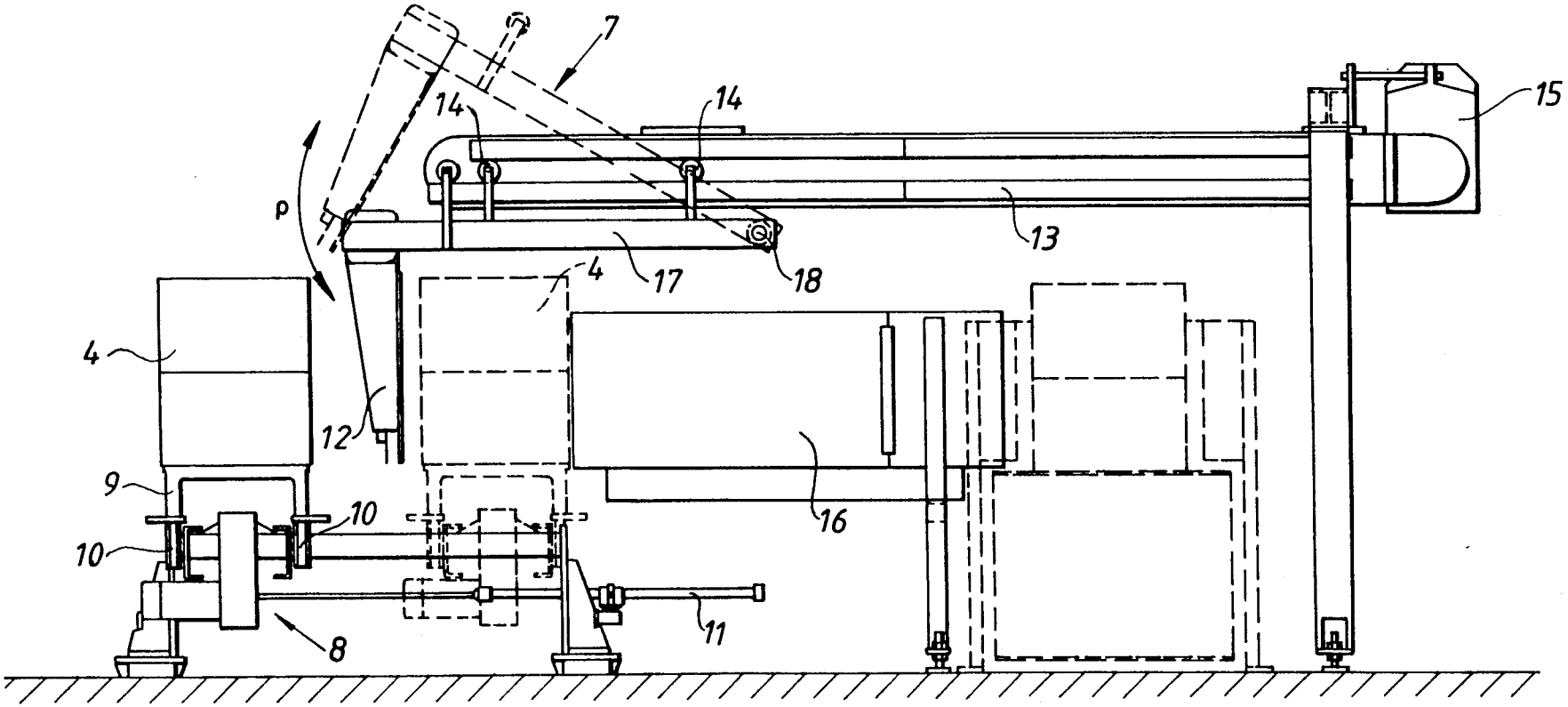

FIG. 2 shows an embodiment of a unit for using the procedure. The unit is placed as suggested by the section arrows II—II on FIG. 1.

The molds 4 are placed on top of each other with horizontal dividing surface, resting on the pallet 9. The pallet is normally conveyed out of the plane of the paper by rolling on the wheels 10, and from there on along the conveyor 5 (FIG. 1), comprising a number of corresponding pairs of wheels, of which the pairs of wheels lying at the entry end of the conveyor are adapted to transmit a propulsive force, whereas the pairs of wheels placed at the exit end of the conveyor are adapted to transmit braking forces, these pairs of wheels being provided with a friction coating.

When the molds 4 have passed the stretch along the first conveyor 5 and the second conveyor 6, they have been placed in the position suggested by the dotted lines on FIG. 2 just to the right of the molds 4 shown in solid lines. In that position the molds 4 are in line with the molds shown by the solid lines at the delivery end 2 of the molding machine. The molds 4 rest on the pallet 9.

By means of the ejector element 7 the molds 4 are taken transversely to the conveyor 6 and on to the cooling conveyor 3 through an ejector channel 16, whose bottom is in line with the top side of the pallet.

The ejector element 7 is adapted as a principally L-shaped arm, which is suspended pivotally at one end in a bearing 18, and which by its other, short arm is provided with an ejector blade 12, which is adapted to abut against the lateral surface of the molds 4. The bearing 18 is adapted in a trolley 17, which via running rollers 14 is suspended in running rails 13. The transverse movement of the trolley 17 and thereby by the ejector blade 12 is effected by a motor 15 and a power transmission element, for example a toothed belt (not shown), which is inserted between the motor 15 and the trolley 17.

As suggested by the dotted lines and the double arrow P the ejector element 7 can be turned around the bearing 18 between an initial position (solid lines), in which the ejector blade 12 is placed behind the lateral surface of the molds 4, and a position (dotted lines), in which the ejector element 7 has been swung up above the level of the molds 4. The swing is effected by a power cylinder (not shown).

When the ejector blade 12 has moved the molds 4 to the left on FIG. 2 and on to the cooling conveyor 3, the empty pallet 9 and the underframe with the wheels 10 are moved to the left to the initial position shown by solid lines in front of the delivery end 2 of the molding machine 1. During this passage the ejector blade 12 is kept low. The transverse movement of the empty pallet 9 is effected by means of the power cylinder 11.

When for some reason the molds 4 cannot or shall not be used for pouring, the present invention makes it possible to bypass the "wrong" molds 4' by activating the power cylinder 11 to perform its return stroke while pallet 9 and molds 4 are placed above the wheels 10 of the underframe. At the same time the power cylinder is activated that causes the ejector element 7 to swing away to the position to the position shown by dotted lines. The pallet 9 with "wrong" molds 4' can then be moved unhindered to the position suggested by dotted lines. The sequence is completed by the ejector blade 12 being swung back to its work position shown by solid lines, whereupon the motor 15 effects the transverse movement of the trolley 17, so that the "wrong" molds 4' are moved transversely through the ejector channel 16, as described above in connection with the path of the "normal" molds.

Figure 3:
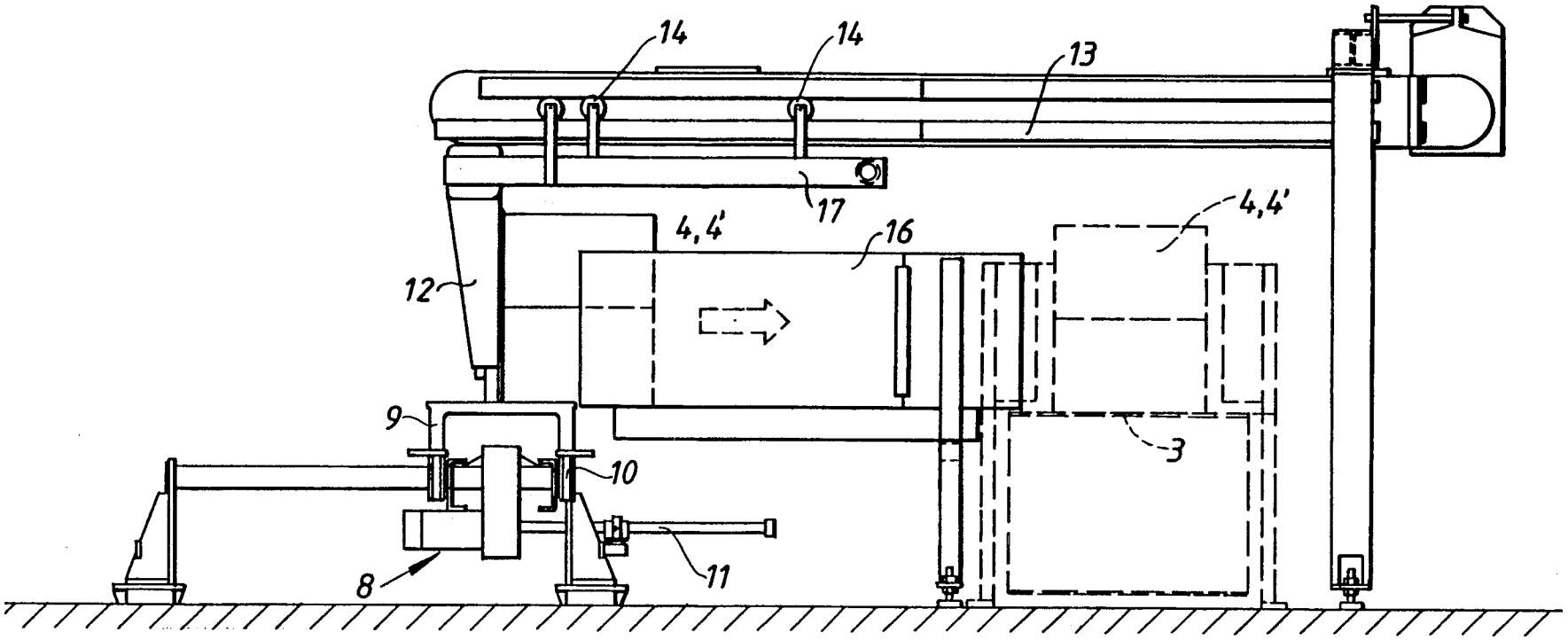

FIG. 3 illustrates a special work position of the unit described under FIG. 2. The ejector blade 12 has moved the molds 4 a short distance into the ejector channel 16 and partly away from the pallet 9. The cross-conveyor 8 for the pallets locks in the extreme position where the wheels 10 align with and form a continuation of the wheel pairs on the conveyor 6. The individual elements have the same references as the corresponding elements on FIG. 2.

The present invention is not limited to just the features shown and described. Instead of the pivotal ejector blade 12 a technically equivalent solution can be used for moving the ejector blade between the work position and the position in which it clears the transverse passage of the molds 4, between the two conveyors. For example, a translational, vertical movement could be used.

I claim:

1. In a method for conveying molds from the delivery end of a molding machine to a cooling conveyor or an extractor station, wherein the molds are conveyed in a direction away from the molding machine in close mutual contact with each other on a first conveyor at which pouring takes place, and are then conveyed back in the direction of the molding machine on a second conveyor which extends parallel to said first conveyor and on which initial cooling and solidification take place, whereupon the molds with partially cooled castings formed therein are ejected onto the cooling conveyor or to the extractor station by the action of a reciprocating ejector element which is adapted to move the molds transversely away from the second conveyor, the improvement comprising controlling the molds delivered by the molding machine by ejecting defective molds having irregularities or flaws therein transversely from the first conveyor in the direction of the second conveyor immediately upon leaving the molding machine and thereafter conveying the defective molds to the cooling conveyor or the extractor station by the action of the ejector element.

2. A method according to claim 1, wherein the conveyors each include an exit end and an entry end, wherein the molds from the molding machine are delivered to a transport pallet and the molds are conveyed by the transfer pallet along the first conveyor and the second conveyor, and wherein a cross-conveyor moves empty pallets from the exit end of the second conveyor to the entry end of the first conveyor, the further improvement comprising moving the pallet with the defective molds thereon by the cross-conveyor from the entry end of the first conveyor to the exit end of the second conveyor during the return stroke of the cross-conveyor while moving the ejector element out of the path of the defective molds.

3. In a molding plant comprising a molding machine having a delivery end, a first conveyor, having an entry end to receive molds delivered from the delivery end of the molding machine, for conveying the molds in closely held together end-to-end relation, and along which conveyor pouring is carried out to produce poured castings, a turning station on which the molds are turned individually through 180°, and a second conveyor having an exit end on which the molds and poured castings are cooled while the closely held together molds are conveyed back towards the molding machine, a mold ejector means at the exit end of the second conveyor for moving the molds to a cooling conveyor or an extractor station, the improvement comprising a cross-conveyor means, located at the delivery end of the molding machine, for, together with the ejector means, moving defective molds directly from the entry end of the first conveyor to the cooling conveyor or the extractor station.

4. A plant according to claim 3, further comprising individual pallets rolling on pairs of wheels for conveying said molds, said first conveyor further including an exit end and said second conveyor including an entry and end, and pairs of wheels with a friction coating being disposed at the entry and exit ends of the first and the second conveyors for respectively propelling and braking the pallets, and said cross-conveyor means comprising, disposed between the delivery end of the molding machine and the first conveyor, a pallet cross-conveyor for also carrying empty pallets from the exit end of the second conveyor to the entry end of the first conveyor, said ejector means including an ejector blade projecting downwards to the top of the pallet in the area between the entry end of the first conveyor and the exit end of the second conveyor, and means for pivotably mounting the ejector blade such that said ejector blade can be swung to a level at least corresponding to the height of the molds above the top of the pallets.

5. A plant according to claim 3, further comprising means for detecting defective molds and for producing an activating signal to the pallet cross-conveyor and to the ejector means to provide swinging of the ejector blade to a raised position.

* * * * *